US007847489B2

(12) United States Patent
Lin

(10) Patent No.: US 7,847,489 B2
(45) Date of Patent: Dec. 7, 2010

(54) APPARATUS AND METHOD FOR DRIVING AND ADJUSTING LIGHT

(76) Inventor: Huan-Po Lin, No. 27-4, Lane 109, Guo-Guang Street, Chong-He City, Taipei Hsien (TW)

( * ) Notice: Subject to any disclaimer, the term of this patent is extended or adjusted under 35 U.S.C. 154(b) by 150 days.

(21) Appl. No.: 12/164,002

(22) Filed: Jun. 28, 2008

(65) Prior Publication Data

US 2009/0322254 A1 Dec. 31, 2009

(51) Int. Cl.
*H05B 37/00* (2006.01)

(52) U.S. Cl. ..... 315/291; 315/307; 315/308; 345/102

(58) Field of Classification Search ..... 315/291, 315/307, 308, 312; 345/102
See application file for complete search history.

(56) References Cited

U.S. PATENT DOCUMENTS

2009/0021467 A1* 1/2009 Gohara ..... 345/102

* cited by examiner

*Primary Examiner*—David Hung Vu

(57) ABSTRACT

An apparatus and method for driving and adjusting light is provided, applicable to an LED lighting environment. Without the necessity to change the existing wiring and lighting devices, the apparatus and method for driving and light adjusting apparatus of the present invention can enable the LED driver to adjust light so that the LED lighting device is capable of light adjustment. The apparatus and method for driving and adjusting light of the present invention lets the LED driver output stably drive LED when the input voltage to the LED driver changes so that the LED brightness can maintain stable without flickering regardless of the unstable input voltage as well as with high efficiency and low variation of LED color temperature. In this manner, in addition to the lighting capability, the LED lighting device also has the light adjustment capability because the LED driver has the light adjustment capability.

10 Claims, 11 Drawing Sheets

| Conduction phase angle $\theta^\circ$ | Vin average ($\theta^\circ$--180°) | Vdc_sin(DC Sin Wave) (when $\theta^\circ \leqq 90°$, Peak is 155V) | Vref = Vdc_cancel(Peak) - Vin(average) |
|---|---|---|---|
| Sin 0° | 98.72V | 155V | 155 - 98.72= 56.28V |
| Sin 15° | 97.04V | 155V | 155 - 97.04 = 57.96V |
| Sin 30° | 92.11V | 155V | 155 - 92.11 = 62.89V |
| Sin 45° | 84.27V | 155V | 155 - 84.27 = 70.73V |
| Sin 60° | 74.04V | 155V | 155 - 74.04 = 80.96V |
| Sin 75° | 62.14V | 155V | 155 - 62.14 = 92.86V |
| Sin 90° | 49.36V | 155V | 155 - 49.36 = 105.64V |
| Sin 105° | 36.59V | 149.72V | 149.72 - 36.59 = 113.13V |
| Sin 106° | 35.76V | 149V | 149 - 35.76 = 113.24V |
| Sin 107° | 34.93V | 148.23V | 148.23 - 34.93 = 113.29V |
| Sin 108° | 34.11V | 147.41V | 147.41 - 34.11 = 113.3V |
| Sin 109° | 33.29V | 146.55V | 146.55 - 33.29 = 113.26V |
| Sin 110° | 32.48V | 145.65V | 145.65 - 32.48 = 113.17V |
| Sin 120° | 24.68V | 134.23V | 134.23 - 24.68 = 109.55V |

Vref decreasing from 109°

FIG. 10

APPARATUS AND METHOD FOR DRIVING AND ADJUSTING LIGHT

BACKGROUND OF THE INVENTION

1. Field of the Invention

The present invention generally relates to an apparatus and method for driving and adjusting light, and more specifically to an apparatus and method for driving and adjusting light of a light-emitting diode (LED) lighting device, without the necessity to change the existing wiring or the structure of the lighting device, to change the lighting by using the apparatus and method for driving and adjusting light so that an LED driver has the light-adjustment capability and the lighting of the LED lighting device is adjustable.

2. The Prior Arts

As the environmental consciousness increases and the energy consumption awareness becomes an agenda, the LED lighting devices gain popularity because of the superior energy efficiency in comparison with the conventional incandescent lamps and fluorescent lighting devices. Therefore, LED is replacing the conventional incandescent or fluorescent bulbs in many lighting devices.

At present, the LED driver design focuses on how the LED driver keeps the LED in stable brightness when the input voltage changes. The advantages of this design approach include that (1) LED has a steady brightness, which does not flicker because of the change of unstable input voltage; (2) High efficiency; and (3) LED has steady color temperature. However, the disadvantage is that additional control signals are required for LED light adjustment; therefore, with the restrictions of the existing wiring, the structure of the lighting device and the light adjustment device, it is difficult to provide light adjustment for LED because this may imply re-wiring and purchase of new lighting device and light adjustment device. Therefore, the LED lighting device is still unable to replace the existing lighting devices.

The LED lighting device driven by AC directly is available, but the disadvantages include low efficiency, LED flickering because of current frequency, and high variation of LED color temperature. Also, because of being driven by AC directly, LED shows different color temperature at different voltage.

In addition, for the existing light adjusting apparatus, the light adjustment function is achieved by adjusting the power source voltage. However, the conventional fluorescent tube and energy-efficient bulb are not adjustable. In general, the following approaches are used for voltage adjustment. The first is to use a variable resistor to split the voltage. The second is to use a TRIAC or SCR to control the phase of the voltage conduction. However, when applied to the existing design for driving an LED, these approaches cannot achieve the object of light adjustment.

Hence, it remains an important issue in the LED driver design to replace the existing lighting with the LED without the necessity to change the existing wiring or the structure of the light device so that the LED light can be adjusted in addition to the lighting capability. In the mean time, how to maintain the steady brightness and avoid flickering caused by unstable input voltage, maintain high efficiency and low color temperature variation are also important issues to be solved.

SUMMARY OF THE INVENTION

The primary objective of the present invention is to provide an apparatus and method for driving and adjusting light, applicable to an LED lighting device so that, by using the apparatus and method for driving and adjusting light of the present invention and without the necessity to change the existing wiring or the structure of the light device, the LED light can be adjusted.

Another objective of the present invention is to provide an apparatus and method for driving and adjusting light, applicable to an LED lighting device so that, without the necessity to change the existing wiring or the structure of the light device, when the input voltage to LED driver changes, the LED driver can maintain stable output to drive LED; therefore, the LED light can be adjusted to achieve better lighting effect and energy efficiency.

Yet another objective of the present invention is to provide an apparatus and method for driving and adjusting light, applicable to an LED lighting device so that, without the necessity to change the existing wiring or the structure of the light device, the LED brightness can maintain stable without flickering regardless of the unstable input voltage as well as with high efficiency and low variation of LED color temperature.

To achieve the above objectives, the present invention provides an apparatus for driving and adjusting light. The apparatus for driving and adjusting light outputs the brightness control signal to the LED driver so that the LED driver has the light adjustment capability and the LED lighting device can be adjusted for different brightness. The apparatus and method for driving and adjusting light of the present invention lets the LED driver output stably drive LED when the input voltage to LED driver changes so that the LED brightness can maintain stable without flickering regardless of the unstable input voltage as well as with high efficiency and low variation of LED color temperature. In this manner, in addition to the lighting capability, the LED lighting device also has the light adjustment capability because the LED driver has the light adjustment capability.

The driving and light adjusting apparatus of the present invention includes a voltage change detection module, a delta detection and checking module and a brightness control signal generator.

The voltage change detection module is for detecting the change in the input voltage and outputting a change reference signal Vref to the delta detection and checking module. The delta detection and checking module can detect the change amount in the voltage by detecting the change of Vrms (Voltage of root-mean-square), the phase angle of conduction or the conduction time of the power source.

The delta detection and checking module compares Vref from the voltage change detection module and a base power source voltage Vcc to find a difference (i.e., delta), where Vcc can be a base power source voltage external to the driving and light adjusting apparatus generated by an external circuit, or a stable voltage provided internally by the driving and light adjusting apparatus. The delta detection and checking module outputs the delta signal to the brightness control signal generator.

Based on the delta signal from the delta detection and checking module, the brightness control signal generator will generate a brightness control signal and transmit the brightness control signal to the LED driver external to the driving and light adjusting apparatus so that the LED driver can adjust the brightness of the LED light.

The method of using the driving and light adjusting apparatus includes the following steps. First, the voltage change detection module detects the input voltage change, and transmits the change reference signal Vref to the delta detection and checking module. Then, the delta detection and checking module compares Vref with an external power source voltage Vcc, and transmits a delta signal to the brightness control signal generator. Finally, based on the delta signal, the brightness control signal generator generates a brightness control signal and transmits the brightness control signal to the LED driver so that the LED driver can adjust the brightness of the LED light.

The foregoing and other objectives, features, aspects and advantages of the present invention will become better understood from a careful reading of a detailed description provided herein below with appropriate reference to the accompanying drawings.

BRIEF DESCRIPTION OF THE DRAWINGS

The present invention can be understood in more detail by reading the subsequent detailed description in conjunction with the examples and references made to the accompanying drawings, wherein:

FIG. 10 shows a schematic view of the relation between conduction phase angle, Vin average value, DC sine-wave and Vref of FIG. 9.

DETAILED DESCRIPTION OF THE PREFERRED EMBODIMENT

Figure 1:
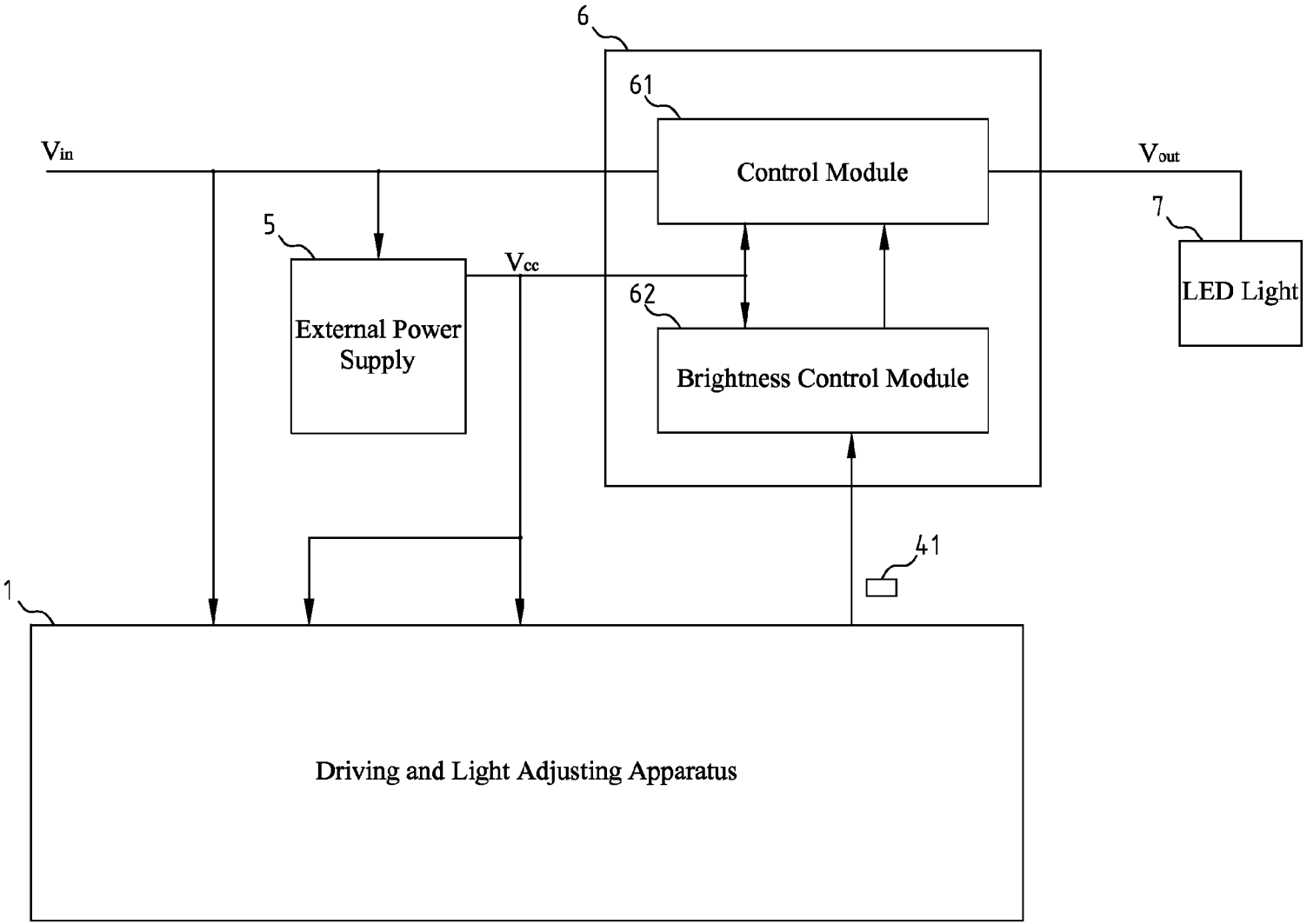
FIG. 1 shows a schematic view of the driving and light adjusting apparatus of the present invention operating with a power supply, an LED driver and an LED light.

FIG. 1 shows a schematic view of a driving and light adjusting apparatus of the present invention operating with a power supply, an LED driver and an LED light. As shown in FIG. 1, the driving and light adjusting apparatus 1 cooperates with an external power supply 5, an LED driver 6 so that the LED driver 6 can steadily drive an LED light 7, where the LED driver 6 includes a control module 61 and a brightness control module 62.

The power supply 5 performs regulation and filtering to transform a stabilized power source voltage Vin into power source voltage Vcc, and provides Vcc to the driving and light adjusting apparatus 1 so that the driving and light adjusting apparatus 1 can use Vcc as a basis for delta comparison.

The brightness control module 62 of the LED driver 6 is the module for adjusting brightness. By transmitting pulse width modulation (PWM) or DC signal to the brightness control module 62, the objective of the light adjustment can be achieved. The control module 61 of the LED driver 6 is to transmit voltage Vout to the LED light 7 so as to drive the LED light 7 steadily.

The driving and light adjusting apparatus 1 receives Vcc from the power supply 5 and detects the voltage change in Vin. Then, the driving and light adjusting apparatus 1 generates a brightness control signal 41 accordingly and transmits the brightness control signal 41 to the LED driver 6 so that the LED driver 6 can adjust the brightness of the LED light 7.

When Vin changes, the driving and light adjusting apparatus 1 can still maintain the LED driver 6 to drive the LED light 7 steadily and prevent LED brightness from flickering because of the unstable input voltage, as well as maintain high efficiency and low color temperature variation. Therefore the LED light 7 can be adjusted because of the LED driver 6 in addition additional to the lighting function.

Figure 2:
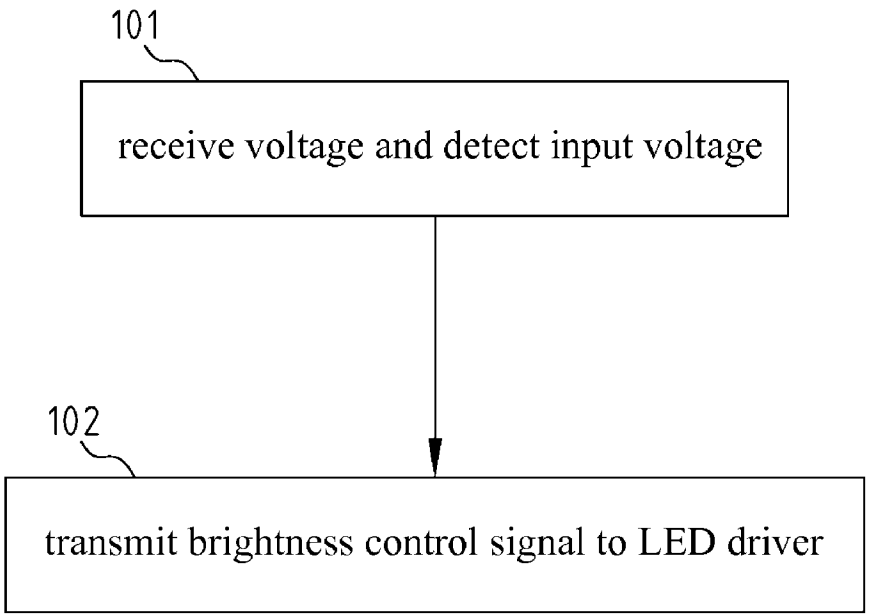
FIG. 2 shows a flowchart of a method for driving and adjusting light using the driving and light adjusting apparatus of the present invention.

FIG. 2 shows a flowchart of the method for driving and adjusting light of the present invention. As shown in FIG. 2, step 101 is for the driving and light adjusting apparatus 1 to receive Vcc from the power supply 5 and detects the change in voltage Vin. Step 102 is for the driving and light adjusting apparatus 1 to generate, based on Vin, and Vcc, a corresponding brightness control signal 41 and to transmit the brightness control signal 41 to the LED driver 6 so that the LED driver 6 can adjust the brightness of the LED light 7.

Figure 3:
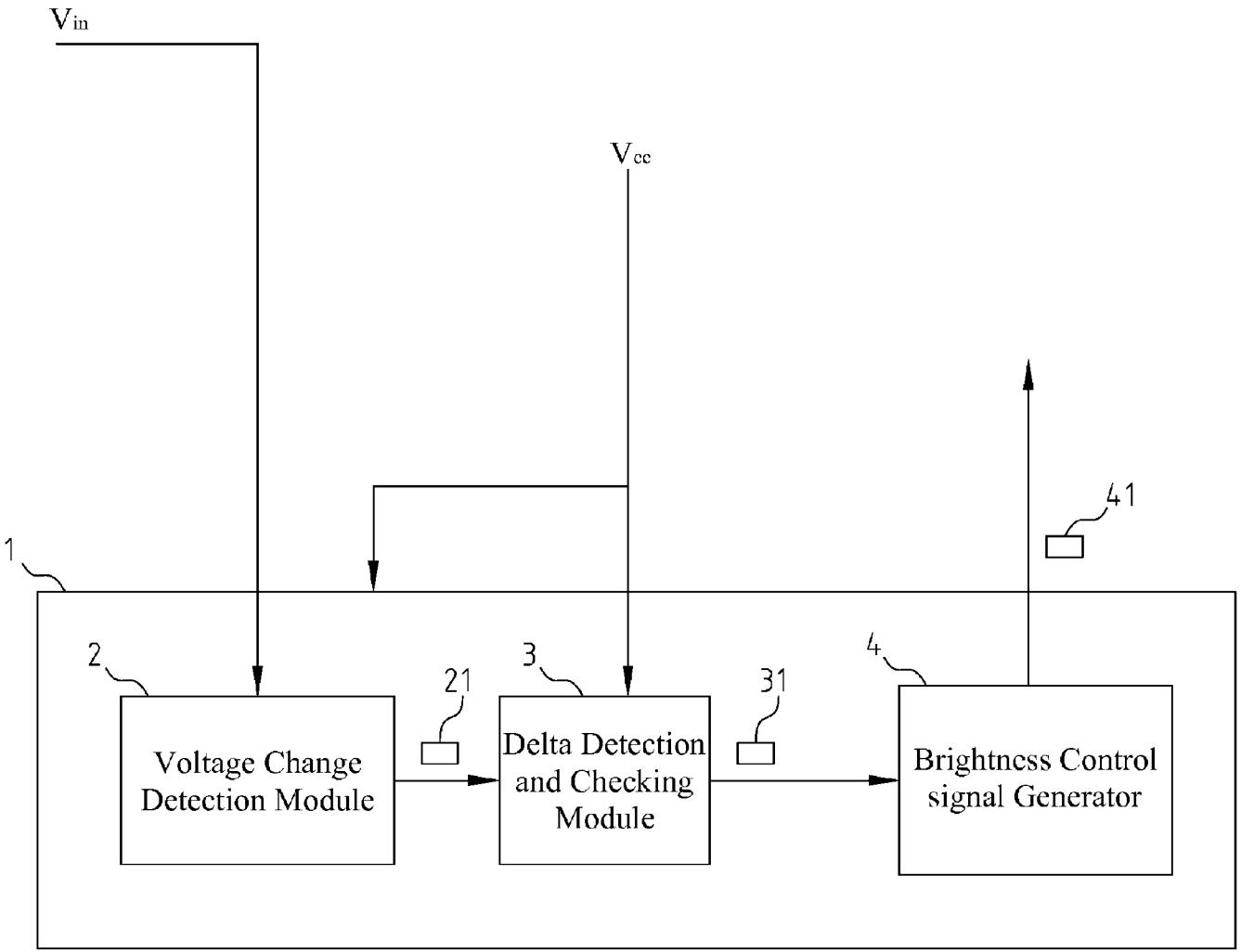
FIG. 3 shows a schematic view of the structure of an embodiment of the driving and light adjusting apparatus of the present invention.

FIG. 3 shows a schematic view of a structure of an embodiment of the driving and light adjusting apparatus of the present invention. As shown in FIG. 3, the driving and light adjusting apparatus includes a voltage change detection module 2, a delta detection and checking module 3 and a brightness control signal generator 4.

The voltage change detection module 2 detects the voltage change in input voltage Vin and transmits a change reference signal Vref 21 to the delta detection and checking module 3. When the input voltage is AC, the voltage change detection module 2 can detect the amount of change by detecting the Vrms (Voltage of root-mean-square) change, the conduction phase angle and the conduction time of the AC power source. When the input voltage is DC, the voltage change detection module only needs to detect the amount of change by detecting the DC voltage value.

The delta detection and checking module 3 compares the signal Vref 21 from the voltage change detection module 2 with Vcc from the external power supply 5 (not shown) and transmits a delta reference signal delta 31 to the brightness control signal generator 4.

Based on the delta 31 from the delta detection and checking module 3, the brightness control signal generator 4 generates a brightness control signal 41 and transmits the brightness control signal 41 to the external LED driver 6 (not shown) so that the LED driver 6 can adjust the brightness of the external LED light 7 (not shown).

Figure 4:
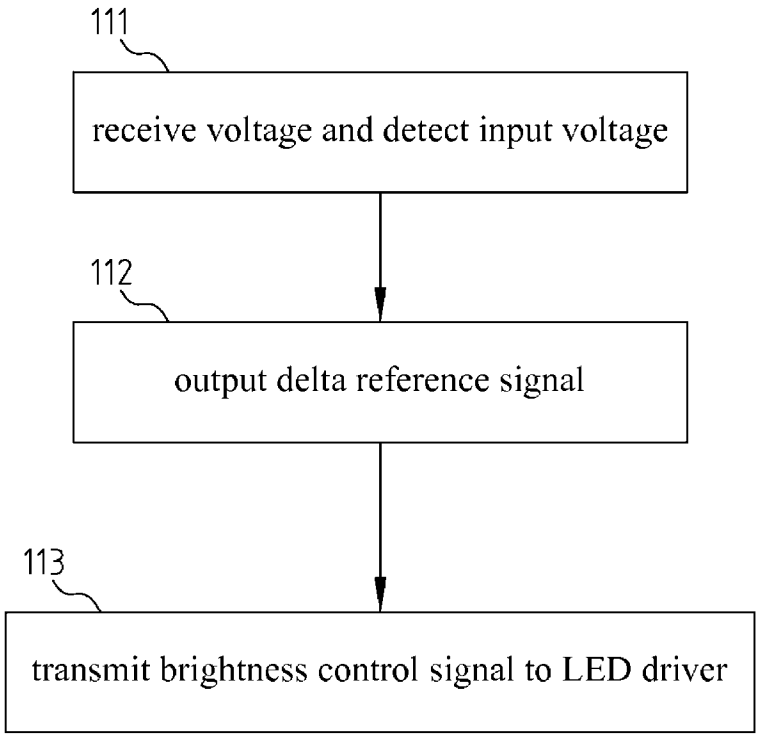
FIG. 4 shows a flowchart of a method for driving and adjusting light using the driving and light adjusting apparatus of FIG. 3.

FIG. 4 shows a flowchart of a method of using the driving and light adjusting apparatus of FIG. 3 to drive and adjust light. As shown in FIG. 4, step 111 is for the voltage change detection module 2 to detect the voltage change in input voltage Vin and to transmit a change reference signal Vref 21 to the delta detection and checking module 3. Step 112 is for the delta detection and checking module 3 to compare Vref 21 from the voltage change detection module 2 with Vcc from the external power supply 5 and to transmit a signal delta 31 to the brightness control signal generator 4. Step 113 is for the brightness control signal generator 4 to generate, based on the delta 31, a brightness control signal 41 and to transmit the brightness control signal 41 to the external LED driver 6 so that the LED driver can adjust the brightness of the external LED light 7.

Figure 5:
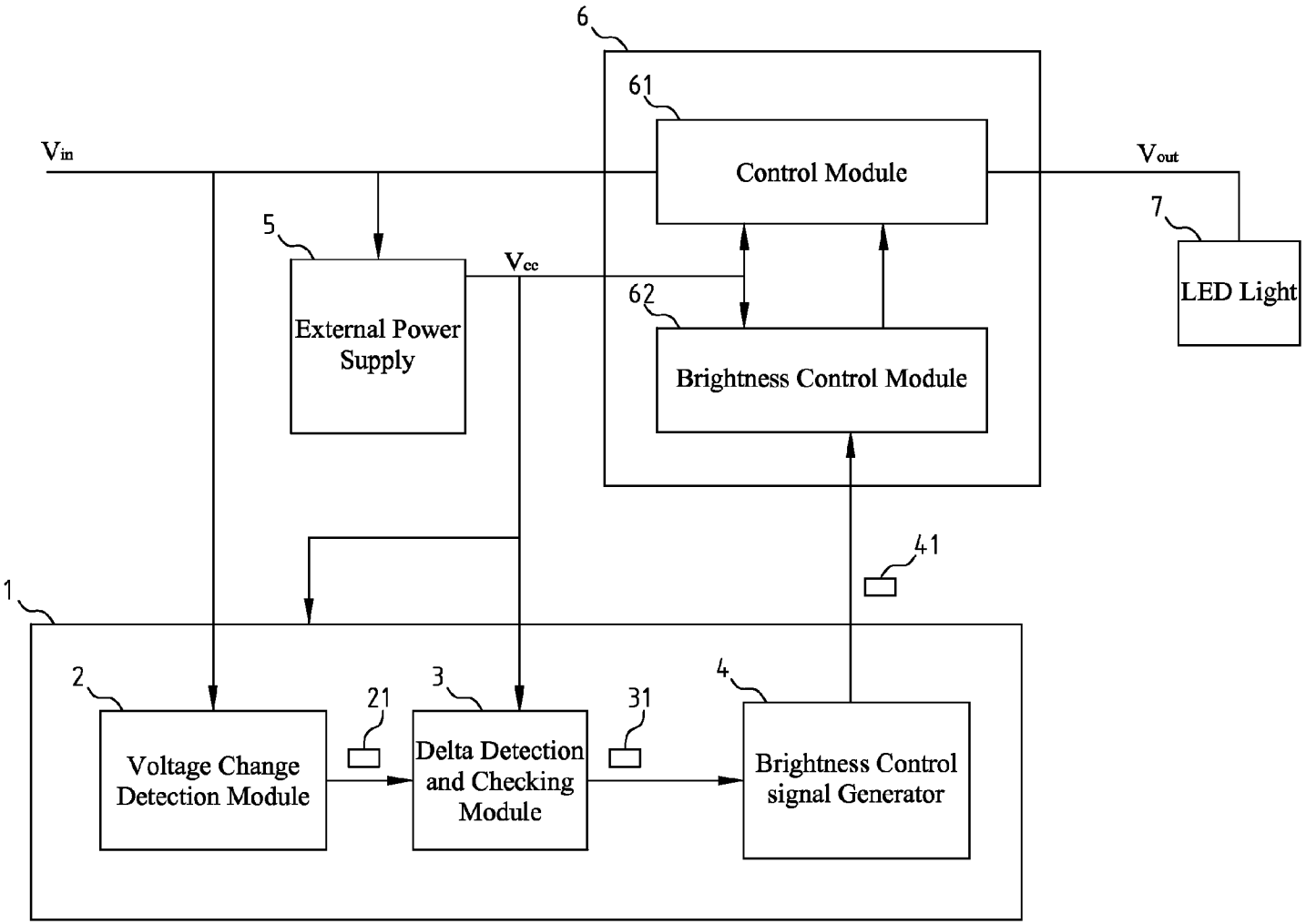
FIG. 5 shows a schematic view of the driving and light adjusting apparatus of FIG. 3 operating with a power supply, an LED driver and an LED light.

FIG. 5 shows a schematic view of the apparatus of FIG. 3 operating with the power supply and the LED driver. As shown in FIG. 5, the driving and light adjusting apparatus 1 must cooperate with the external power supply 5 and the external LED driver 6 so that the LED driver 6 can drive the external light 7 steadily.

As shown in FIG. 5, the driving and light adjusting apparatus 1 includes a voltage change detection module 2, a delta detection and checking module 3 and a brightness control signal generator 4. The LED driver 6 includes a control module 61 and a brightness control module 62.

The power supply 5 performs regulation and filtering to transform a stabilized power source voltage Vin into power source voltage Vcc, and provides Vcc to the driving and light adjusting apparatus 1 so that the driving and light adjusting apparatus 1 can use Vcc as a basis for delta comparison.

The common light adjustment approaches are by using pulse width modulation (PWM) to adjust light, and by using linear DC to adjust light. Brightness control module 62 of the LED driver 6 is the module for adjusting brightness. By transmitting pulse width modulation (PWM) or DC signal to the brightness control module 62, the objective of light adjustment can be achieved. The light adjustment approach is to add a control line to the LED light so that the LED light must have at least three contact points; i.e., two for power supply and one for brightness control signal. The control module 61 of the LED driver 6 is to transmit voltage Vout to the LED light 7 so as to the drive LED light 7 steadily.

The voltage change detection module 2 detects the voltage change in input voltage Vin and transmits a change reference signal Vref 21 to the delta detection and checking module 3. The voltage change detection module 2 can detect the amount of change by detecting the voltage change, the conduction phase angle and the conduction time of the AC power source. The voltage change detection module 2 can be realized with circuit, such as, a loop circuit with R/L/C/Zener Diode/Transistor, or IC circuit, such as ADC (Analog to Digital Convert) IC chip and external circuits.

The delta detection and checking module 3 compares signal Vref 21 from the voltage change detection module 2 with Vcc from the power supply 5 and transmits a delta reference signal delta 31 to the brightness control signal generator 4.

Based on the delta 31 from the delta detection and checking module 3, the brightness control signal generator 4 generates a brightness control signal 41 and transmits the brightness control signal 41 to the LED driver 6 so that the LED driver 6 can adjust the brightness of the external LED light 7.

Figure 6:
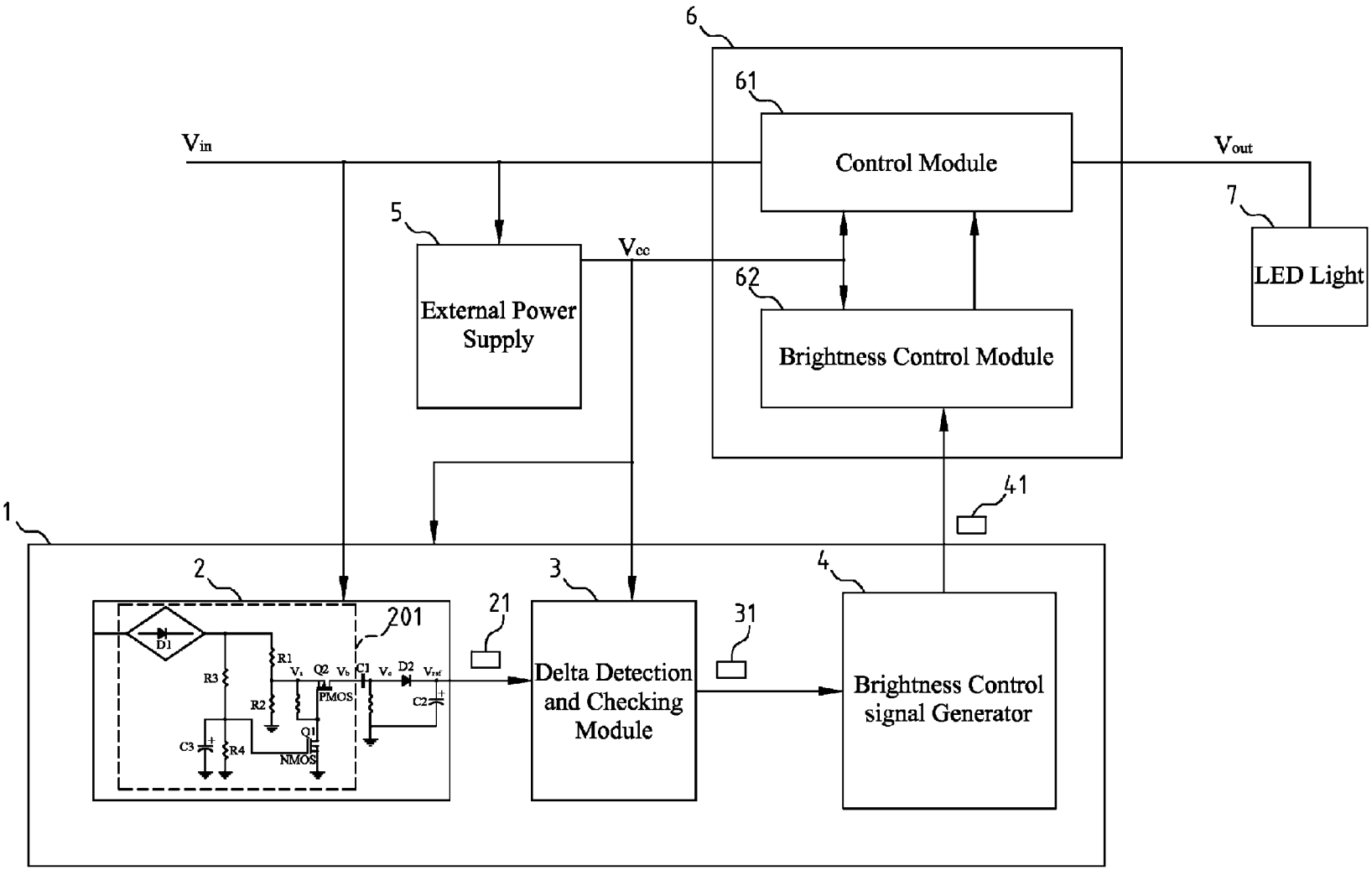
FIG. 6 shows a circuit for describing the driving and light adjusting apparatus of FIG. 3 applied to TRIAC continuous light adjustment.

FIG. 6 shows a circuit for describing TRIAC continuous light adjustment using the apparatus of FIG. 3. In this application, the driving and light adjusting apparatus 1 is used in TRIAC continuous light adjustment (by changing AC conduction phase angle θ), where the positive light adjustment is defined as the lower the voltage, the lower the brightness; on the other hand, the negative light adjustment is defined as the lower the voltage, the higher the brightness. The power supply 5 regulates and filters input voltage Vin into voltage Vcc. For example, Vin is AC 110V and Vcc is DC 5V. The delta |Vref−Vcc| can be designed as $0 \leqq |Vref-Vcc| \leqq 5V$ (DC). That is, the maximum delta is DC 5V and the minimum delta is 0V, where Vref is the change reference signal Vref 21.

When input voltage Vin is AC 110V full conduction (with phase angle 0°), delta |Vref−Vcc| has the maximum value, i.e., DC 5V. Therefore, the signal delta 31 outputs DC 5V. The brightness control signal generator 4, according to the delta 31, transmits the brightness control signal 41 with the highest brightness.

When the conduction phase angle of input voltage Vin is greater than 0°, the Vrms value of Vin will decrease; therefore, delta |Vref−Vcc| will also decrease. Hence, the signal delta 31 outputs a smaller value. The brightness control signal generator 4, according to the delta 31, transmits the brightness control signal 41 with the lower brightness to the LED driver 6 so that the LED driver 6 can lower the brightness of the LED light 7.

As shown in FIG. 6, the voltage change detection module 2 includes a rectifier circuit 201. The voltage change detection module 2 and the rectifier circuit 201 include diodes, resistors, capacitors, PMOS and NMOS elements. By using the features of rectified AC sine-wave with different conduction phase angle has different DC component, the voltage change can be detected.

In the above example, input voltage Vin is a standard AC 100V sine-wave, Va is a rectified DC sine-wave, Vb is a proper low voltage DC sine-wave obtained from R1/R2 voltage division, R3, R4, C3 and Q1 shut off switch Q2 when conduction phase angle is greater than 105°, which will be described momentarily. After C1 filtering out the DC component of Vb, AC Vc can be obtained. After Vc passes filtering of negative half period, C2 filters Vc and obtains peak voltage Vref. Vref is DC voltage and is used as the reference signal Vref 21.

Figure 7:
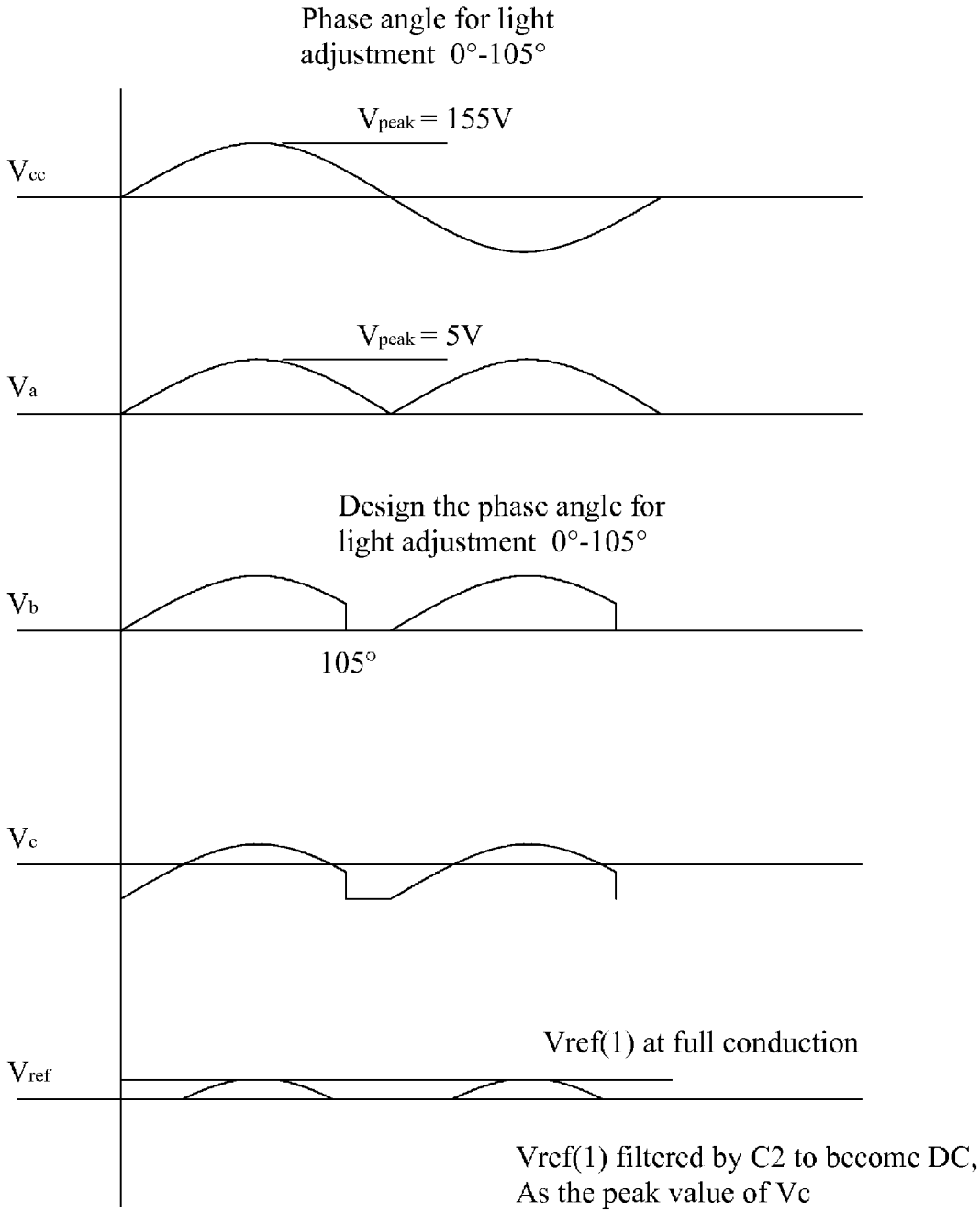
FIG. 7 shows a schematic view of the voltages Vcc, Va, Vb, Vc and Vref when the change reference signal in FIG. 6 is full conduction.
Figure 8:
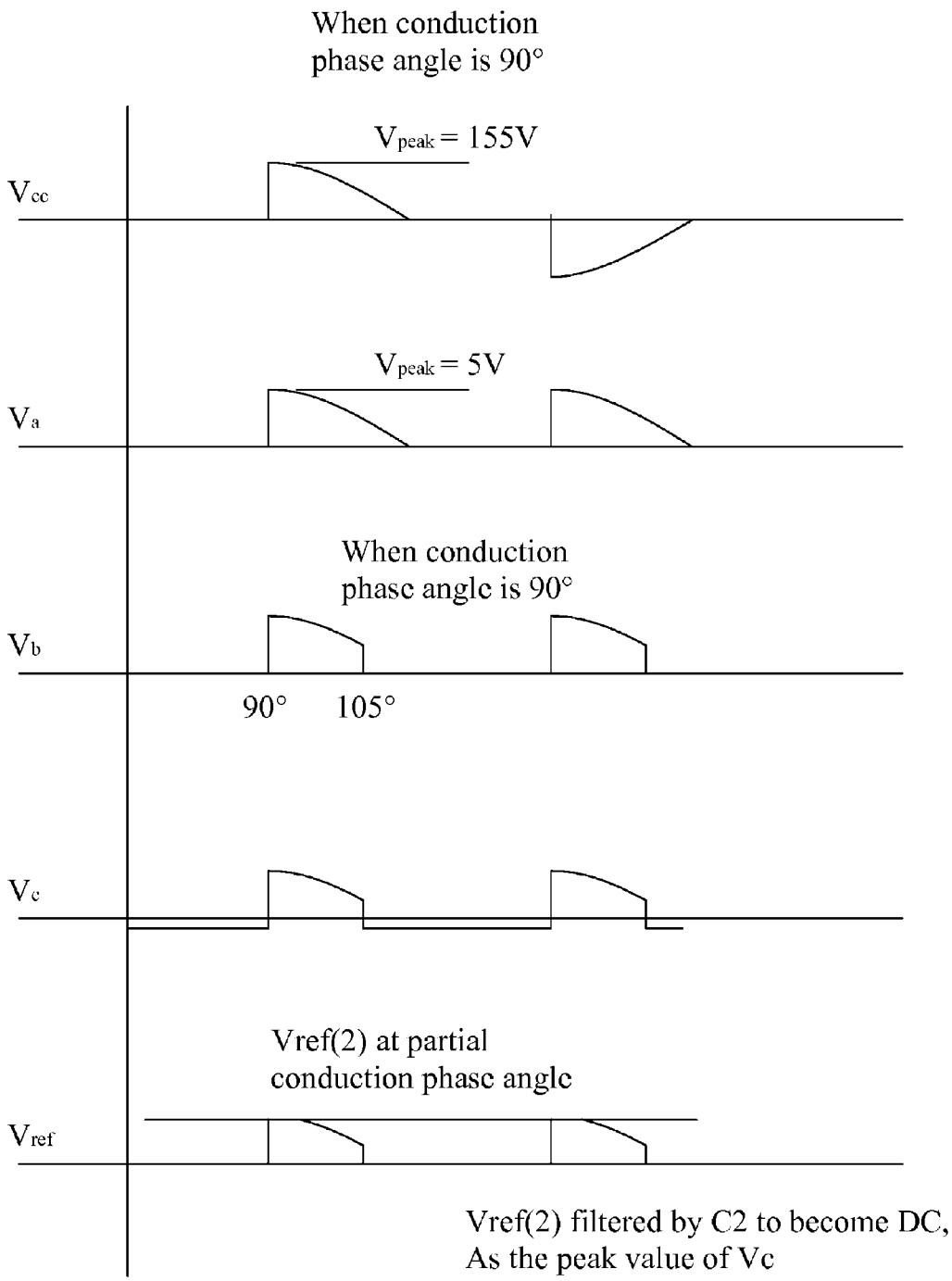
FIG. 8 shows a schematic view of the voltages Vcc, Va, Vb, Vc and Vref when the change reference signal in FIG. 6 is 90° conduction.

FIG. 7 shows a view when Vref21 is Vref(1) where Vref(1) is full conduction. FIG. 8 shows a view when Vref 21 is Vref(2) where Vref(2) is 90° conduction. Vref(1)<Vref(2). Different Vref indicates the voltage change in the input voltage.

FIG. 7 shows a schematic view of the voltage of Vcc, Va, Vc and Vref when Vref 21 in FIG. 6 is full conduction. As shown in FIG. 7, the phase angle for light adjustment is between 0° and 105°, Vpeak of Vcc is 155V, Vpeak of Va is 5V, where Vc is the voltage after C1 filtering out the DC component, Vref (1) is the peak voltage of Vref obtained by using D2 to filter the negative half wave of Vc and then filtered by C2.

FIG. 8 shows a schematic view of the voltage of Vcc, Va, Vc and Vref when Vref 21 in FIG. 6 is in 90° conduction. As shown in FIG. 8, the conduction phase angle is 90°, Vpeak of Vcc is 155V, Vpeak of Va is 5V, where Vc is the voltage after C1 filtering out the DC component, Vref(2) is the peak voltage of Vref obtained by using D2 to filter out the negative half wave of Vc and then filtered by C2.

Figure 9:
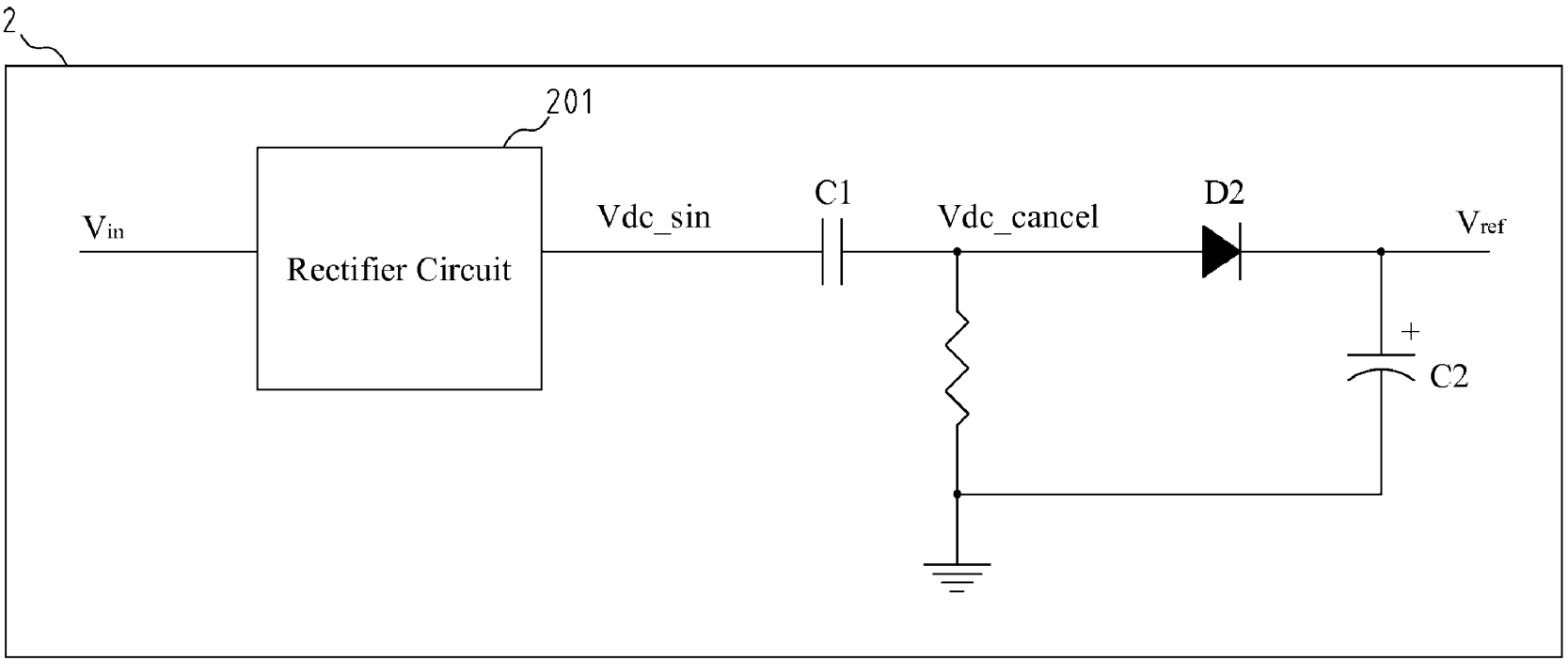
FIG. 9 shows a circuit for describing the operation of the voltage change detection module and the rectifier circuit of FIG. 6.

FIG. 9 is a circuit for describing the operation of the voltage change detection module and the rectifier circuit of FIG. 6. When applied to input AC 110V/220V, Vref of the voltage change detection module 2 will increase as conduction phase angle θ increases when θ<108°. That is, if θ1<θ2<108°, then Vref(θ1)<Vref(θ2). However, when θ>108°, Vref starts to drop. Therefore, the phase angle for light adjustment must be limited to within the range between 0° and 105° to prevent errors. The phase angle range for light adjustment within 0° and 105° is sufficient for most existing TRIAC light adjustment products (currently within 0° and 90°). The voltage change Vref 21 can be known from the AC power source average value. Please be noted that the 0°-105° range limitation is caused by this example schematic structure. It will be no limitation by using other schematic structure such as detecting "conduction phase angle" or total conduction time directly.

FIG. 10 shows a schematic view of the relation between conduction phase angle, Vin average value, DC sine-wave (obtained by using full-wave rectification without filtering)

and Vref of FIG. 9. As shown in FIGS. 9 and 10, Vref (DC) can be filtered by C2 to obtain the peak voltage of Vdc_cancel.

Figure 11:
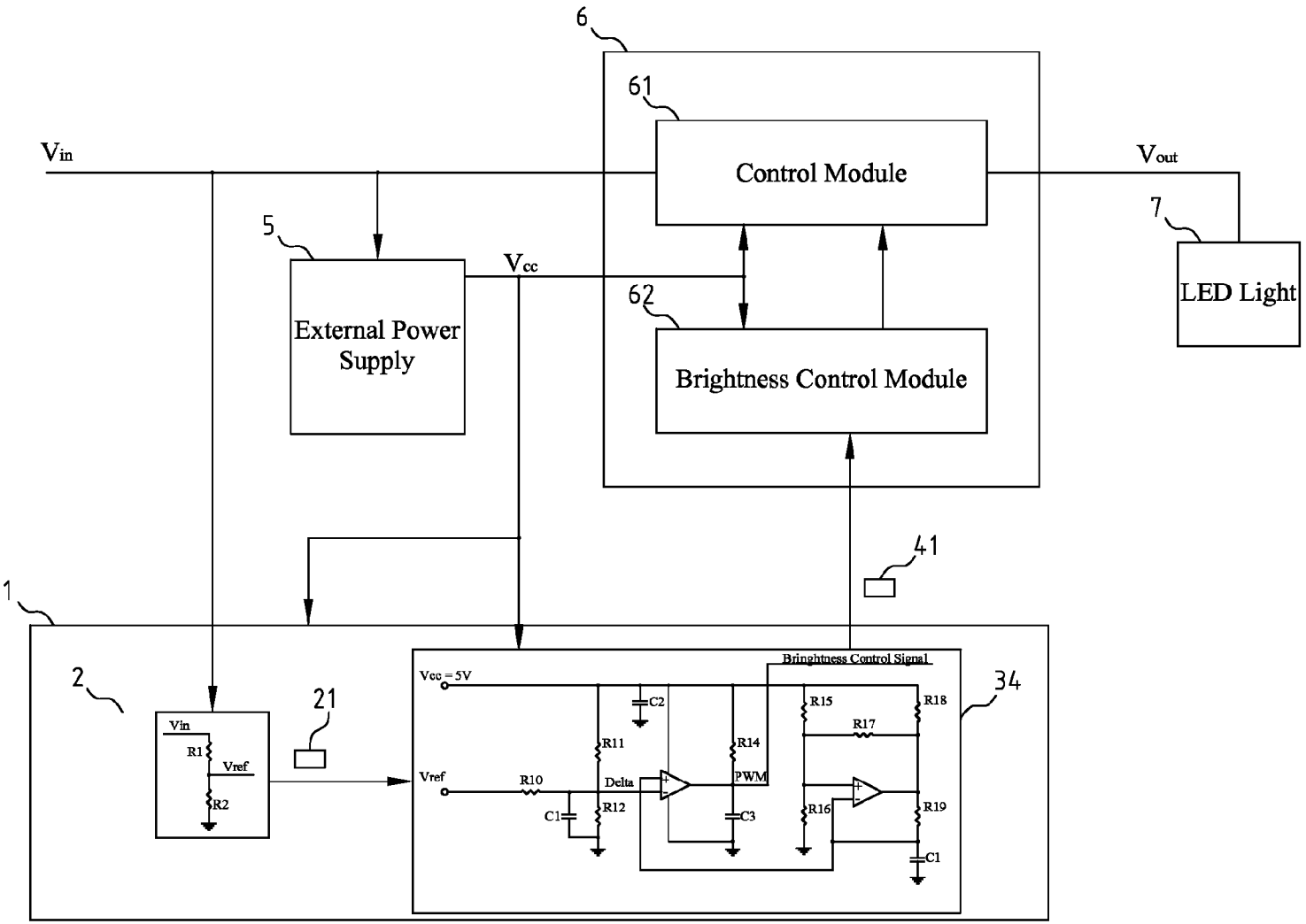
FIG. 11 shows a schematic view of a structure of another embodiment of the driving and light adjusting apparatus of the present invention.

FIG. 11 shows a schematic view of a structure of another embodiment of the driving and light adjusting apparatus of the present invention. As shown in FIG. 11, the driving and light adjusting apparatus 1 includes a voltage change detection module 2, and a compound circuit 34 comprising a delta detection and checking module 3 and a brightness control signal generator 4.

The voltage change detection module 2 is a DC voltage change detection circuit using resistors R1, R2 to divide the voltage. If the rear end elements can endure high voltage, input voltage Vin can be directly used as the change reference signal Vref 21.

The compound circuit 34 comprises a delta detection and checking module 3 and a brightness control signal generator 4. The compound circuit 34 compares Vref 21 and Vcc to obtain a delta 31, uses LM 393 to translate the delta 31 into the brightness control signal 41 (PWM control signal), and then transmits the brightness control signal 41 to the LED driver 6 for controlling brightness. For example, the compound circuit 34 can generate a 1 KHz PWM signal (the brightness control signal 41), and adjust the duty to achieve light adjustment. However, if the LED driver 6 needs a DC brightness control signal 41, a filter circuit can be added between the driving and light adjusting apparatus 1 and the LED driver 6 so that the brightness control signal 41 is a DC signal.

The driving and light adjustment apparatus of the present invention can be applied to LED lighting environment, including continuous light adjustment, such as desk lamp, nightstand lamp, and decorative lights, product display lighting, such as spotlight, and general purpose lighting in offices and household. The continuous light adjustment allows continuous adjustment of light within a range, such as from 0% to 100% or from 10% to 100%. Although the embodiments show the application to TRIAC, SCR or variable resistor voltage-division for adjusting the Vrms (Voltage of root-mean-square) of the power source to achieve light adjustment, the driving and light adjusting apparatus of the present invention can also be applied to other equivalent applications.

In summary of the above embodiments, the apparatus and method for driving and adjusting light of the present invention can be applied to LED lighting devices. Without changing the existing wiring and lighting devices, the driving and light adjusting apparatus of the present invention can be used with the LED driver to enable the LED driver to change the brightness of the LED light accordingly. When the input voltage to the LED driver changes, the apparatus of the present invention enables the LED driver to drive the LED light steadily so that the LED brightness will not flicker because of the unstable input voltage, as well as maintain high efficiency and low color temperature variation. Therefore, the LED driver is capable for light adjustment and the LED light can be adjusted in addition to the lighting capability. In comparison with the existing products, the present invention offers the following advantages:

(1) Without changing the existing wiring and lighting devices, the apparatus of the present invention enable the LED driver to adjust the LED light so that the LED lighting device also has the light adjustment capability.

(2) When the input voltage to the LED driver changes, the apparatus of the present invention maintains the LED driver to drive the LED light steadily so that the LED lighting device can achieve proper lighting effects as well as save energy.

(3) The apparatus of the present invention can maintain the stable LED brightness to avoid flickering caused by unstable input voltage as well as maintain high efficiency and low color temperature variation.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A method for driving and adjusting light, applicable to an LED lighting device, without changing existing wiring and lighting devices, said driving and light adjusting method enabling an LED driver to adjust light so that said LED lighting device is capable of light adjustment, said method comprising the steps of:

using a driving and light adjusting apparatus to receive a constant voltage from a power supply and to detect a voltage change in an input voltage based on comparing a reference voltage derived from said input voltage with said constant voltage; and according to said constant voltage from said power supply and said input voltage, said apparatus generating a corresponding brightness control signal based on said voltage change and transmitting said brightness control signal to said LED diver so as to enable said LED driver to control brightness of light of said LED lighting device.

2. A method for driving and adjusting light, applicable to an LED lighting device, without changing existing wiring and lighting devices, said driving and light adjusting method enabling an LED driver to adjust light so that said LED lighting device is capable of light adjustment, said method comprising the steps of:

using a voltage change detection module to detect a voltage change in an input voltage and transmitting a change reference voltage to a delta detection and checking module;

using said delta detection and checking module for comparing said change reference voltage from said voltage change detection module with a base reference voltage, generating a delta reference signal and transmitting said delta reference signal to a brightness control signal generator; and according to said delta reference signal from said delta detection and checking module, using said brightness control signal generator for generating a brightness control signal and transmitting said brightness control signal to said LED driver so that said LED driver is able to adjust brightness of light of said LED lighting device.

3. A driving and light adjusting apparatus, applicable to an LED lighting device, without changing existing wiring and lighting devices, said driving and light adjusting apparatus enabling an LED driver to adjust light so that said LED lighting device is capable of light adjustment in addition to lighting, said apparatus comprising:

a voltage change detection module, for detecting a voltage change in an input voltage and transmitting a change reference voltage;

a delta detection and checking module for comparing said change reference voltage from said voltage change detection module with a base reference voltage, generating a delta reference signal and transmitting said delta reference signal; and a brightness control signal generator, for, according to said delta reference signal from said delta detection and checking module, generating a brightness control signal and transmitting said brightness control signal to said LED driver so that said LED driver is able to adjust brightness of light of said LED lighting device.

4. The apparatus as claimed in claim 3, wherein said voltage change detection module achieves detection of said voltage change by detecting Vrms (Voltage of root-mean-square) change, conduction phase angle or conduction time of a power source.

5. The apparatus as claimed in claim 3, wherein said voltage change detection module further comprises a circuit comprising R/L/C/Zener Diode/Transistor components.

6. The apparatus as claimed in claim 3, wherein said voltage change detection module further comprises an analog-to-digital (ADC) IC chip.

7. The apparatus as claimed in claim 3, wherein said voltage change detection module further comprises a rectifier circuit, and said voltage change detection module and said rectifier circuit are made of diodes, resistors, capacitors, PMOS and NMOS components.

8. The apparatus as claimed in claim 7, wherein said voltage change detection module uses features of different conduction phase angle and DC component of a rectified AC voltage waveform to achieve detection of said voltage change.

9. The apparatus as claimed in claim 3, wherein said voltage change is obtained by detecting an average voltage change generated by a conduction phase change of said input voltage.

10. A driving and light adjusting apparatus, applicable to an LED lighting device, without changing existing wiring and lighting devices, said driving and light adjusting apparatus enabling an LED driver to adjust light so that said LED lighting device is capable of light adjustment in addition to lighting, said apparatus comprising:

a voltage change detection module, for detecting a voltage change in an input voltage, said voltage change detection module processing said input voltage to obtain a change reference voltage; and a compound circuit, for comparing said change reference voltage from said voltage change detection module with a base power source voltage, generating a delta reference signal, converting said delta reference signal to a brightness control signal, and transmitting said brightness control signal to said LED driver.

* * * * *